United States Patent [19]

Knapp

[11] 4,438,700

[45] Mar. 27, 1984

[54] WHITE SMOKE SPOTTING COMPOSITION FOR TRAINING AMMUNITION

[75] Inventor: Charles A. Knapp, Wayne, N.J.

[73] Assignee: The United States of America as represented by the Secretary of the Army, Washington, D.C.

[21] Appl. No.: 399,601

[22] Filed: Jul. 19, 1982

[51] Int. Cl.[3] ..... F42B 13/44; C06B 33/12

[52] U.S. Cl. ..... 102/334; 102/498; 149/40; 149/41

[58] Field of Search ..... 102/334, 498; 149/40, 149/41

[56] References Cited

U.S. PATENT DOCUMENTS

| | | | |
|---|---|---|---|
| 2,614,083 | 10/1952 | Bailar et al. | 149/41 |
| 3,098,351 | 7/1963 | Higgins | 149/40 |
| 3,274,035 | 9/1966 | Burkardt et al. | 149/40 |
| 3,729,351 | 4/1973 | Kruse | 149/41 |
| 4,227,460 | 10/1980 | Krone et al. | 102/513 |
| 4,237,787 | 12/1980 | Wacula et al. | 102/513 |
| 4,238,254 | 12/1980 | Prähauser et al. | 149/87 |

*Primary Examiner*—Edward A. Miller

*Attorney, Agent, or Firm*—Robert P. Gibson; Anthony T. Lane; A. Victor Erkkila

[57] ABSTRACT

A pyrotechnic spotting charge for training projectiles contains 30–50% zinc powder, 10–30% aluminum powder, 10–30% potassium nitrate or sodium nitrate, and 10–30% potassium perchlorate. The composition (a) is fast reacting and produces a large volume of white smoke visible at a great distance before the projectile buries itself in the ground and (b) is of low brisance and does not cause fragmentation of the projectile.

7 Claims, 1 Drawing Figure

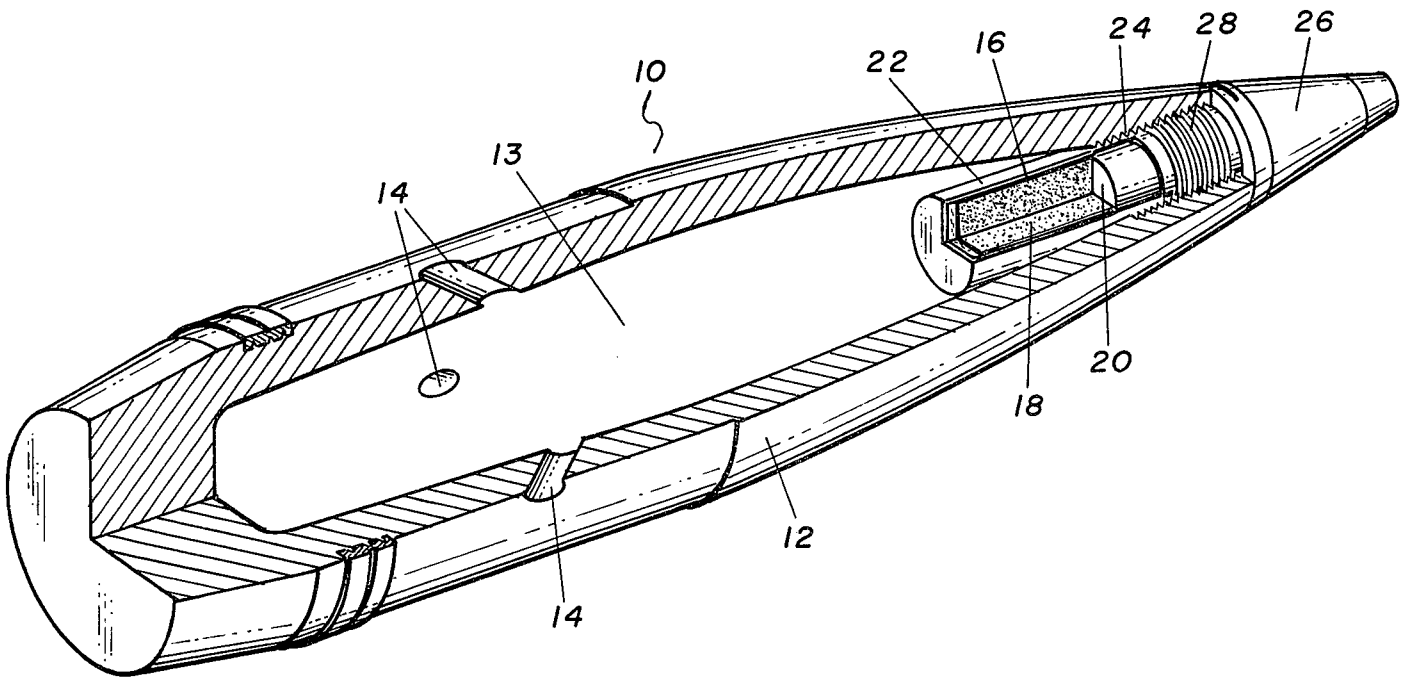
26
28
24
16
22
10
13
14
20
18
12
14

WHITE SMOKE SPOTTING COMPOSITION FOR TRAINING AMMUNITION

GOVERNMENT RIGHTS

The invention described herein may be manufactured, used, and licensed by or for the Government for Governmental purposes without the payment to me of any royalties thereon.

BACKGROUND OF THE INVENTION

The training of personnel in the firing of 155 mm and other artillery ammunition containing a high explosive charge raises serious problems due to the loud noise and ground tremors which result when the projectile explodes or impact with the ground, causing damage to buildings and disturbing people in surrounding communities. To minimize this problem, it has been necessary to limit the training to certain hours of the day which has significantly reduced the quantity of rounds employed for training purposes. This has had a serious adverse effect on the training of personnel and the readiness of our artillery forces.

Accordingly, a primary object of the present invention is to provide a novel fast reacting, white smoke producing pyrotechnic spotting charge of low brisance, which eliminates the aforesaid problems when employed in artillery training ammunition.

Other objects will become apparent from the following description of the present invention.

SUMMARY AND DETAILED DESCRIPTION OF THE INVENTION

In accordance with the present invention there is provided a novel pyrotechnic white smoke spotting composition consisting essentially of the following formulation:

| Ingredient | Percentage (wt) |
|---|---|
| zinc powder | 30–50 |
| aluminum powder | 10–30 |
| potassium or sodium nitrate | 10–30 |
| potassium perchlorate | 10–30 |

Training ammunition according to the present invention can be produced by replacing the high explosive charge in conventional ammunition with a relatively minor amount of the novel spotting composition. A small booster charge is preferably provided to initiate the spotting composition. The booster charge is ignited by a conventional impact fuze on ground impact. The novel spotting composition reacts extremely rapidly to produce a large volume of white smoke, which exits through smoke ports which are provided in the rear portion of the empty shell before the projectile buries itself in the ground. Ignition of the composition when the projectile impacts the ground produces a low level of noise and no ground tremors, and generates a smoke cloud which is visible at a great distance. Further, the composition is of low brisance and does not cause fragmentation of the projectile.

The following is a preferred embodiment of the novel spotting composition of the present invention:

| Ingredient | % by Weight |
|---|---|
| Zinc dust U.S. Specification MIL-Z-365 | 40 |

-continued

| Ingredient | % by Weight |
|---|---|
| Potassium perchlorate U.S. Specification MIL-P-217 Gr.A, Cl.4 | 20 |
| Potassium nitrate U.S. Specification MIL-P-156, Cl. 2 | 20 |
| Aluminum (atomized) U.S. Specification MIL-P-14067 Type II | 20 |

190 grams of the aforesaid composition, prepared by thoroughly blending the powdered ingredients in a mixer, were placed in an aluminum cannister, which was incorporated into an empty standard 155 mm projectile to produce a training round illustrated in longitudinal section in the drawing. As shown in the drawing, the training round 10 includes a hollow standard 155 mm projectile shell 12, which has an empty core 13 and is modified to provide three smoke ports 14 rearwardly slanted in the aft portion of the shell. The cylindrical cannister 16 (2.5 in. long and 1.8 in. dia.) containing the novel spotting composition 18 is placed in a cylindrical liner 22, which is attached at its open end by exterior threads 24 to complementary interior threads in the nose of the shell. The round is provided with a standard impact fuze 26, which contains a small booster charge 20 and is attached by threads 28 to complementary interior threads in the nose of the shell.

Firing tests were carried out with the aforesaid artillery training projectile using a standard propellant charge. On impact with the ground, the spotting composition was initiated by the booster charge ignited by the fuze. The spotting composition reaction was extremely rapid, being complete in less than 1.5 milliseconds, and produced a large volume of white smoke which was forced out of the smoke ports into the atmosphere before the projectile buried itself in the ground. The resulting white smoke cloud was easily visible by artillery spotters at a distance of at least 4000 meters. The explosion on ground impact produced a relatively low level of noise and no ground tremors, and resulted in no fragmentation of the projectile.

I have found that the novel combination and proportions of $KC10_4$ with the gas producing component $KNO_3$ or $NaNo_3$ in the spotting compositions of the present invention provides the extremely rapid and voluminous generation of gas required to expel the smoke before the projectile buries itself in the ground.

The foregoing disclosure and drawings are merely illustrative of the principles of this invention and are not to be interpreted in a limiting sense. I wish it to be understood that I do not desire to be limited to the exact details of construction shown and described because obvious modifications will occur to a person skilled in the art.

I claim:

1. A pyrotechnic spotting composition consisting essentially of 30–50% zinc powder, 10–30% aluminum powder, 10–30% potassium nitrate or sodium nitrate, and 10–30% potassium perchlorate.

2. The composition of claim 1, wherein the nitrate consists essentially of potassium nitrate.

3. The composition of claim 1 consisting essentially of 40% zinc powder, 20% aluminum powder, 20% potassium nitrate, and 20% potassium perchlorate.

4. An artillery training projectile including a spotting composition consisting essentially of 30–50% zinc powder, 10–30% aluminum powder, 10–30% potassium nitrate or sodium nitrate, and 10–30% potassium perchlorate.

5. An artillery training projectile according to claims 4, wherein the spotting composition consists essentially of 40 zinc powder, 20% aluminum powder, 20% potassium nitrate and 20% potassium perchlorate.

6. In an artillery training projectile shell having a hollow core, a smoke producing means activated upon pact disposed in said hollow core, and openings in the aft portion of said shell for exiting smoke produced from said smoke producing means, the improvement wherein the smoke producing means includes a composition consisting essentially of 30–50% zinc powder, 10–30% aluminum powder, 10–30% potassium nitrate or sodium nitrate, and 10–30% potassium perchlorate.

7. An artillery training projectile shell according to claim 6, wherein the smoke producing composition consists essentially of 40% zinc powder, 20% aluminum powder, 20% potassium nitrate and 20% potassium perchlorate.

* * * * *